US005526592A

United States Patent [19]

Bierwith

[11] Patent Number: 5,526,592

[45] Date of Patent: Jun. 18, 1996

[54] TOOTH ASSEMBLY FOR EXCAVATION BUCKET

[76] Inventor: Robert S. Bierwith, 1331 Eastshore Hwy., Berkeley, Calif. 94710

[21] Appl. No.: 279,757

[22] Filed: Jul. 22, 1994

[51] Int. Cl.[6] ..... E02F 9/28

[52] U.S. Cl. ..... 37/451; 37/446; 172/772.5; 299/108

[58] Field of Search ..... 37/396, 398, 446, 37/451, 453; 172/713, 719, 745, 751, 753, 772.5; 299/91, 92

[56] References Cited

U.S. PATENT DOCUMENTS

| | | | |
|---|---|---|---|
| 1,736,045 | 11/1929 | Miley | 37/451 |
| 1,843,205 | 2/1932 | Clark | 37/451 |
| 3,851,413 | 12/1974 | Lukavich | 37/451 |
| 4,238,896 | 12/1980 | Lanz et al. | 37/451 |
| 4,625,437 | 12/1986 | Curtis et al. | 37/451 |
| 5,016,365 | 5/1991 | Robinson | 37/451 |
| 5,088,214 | 2/1992 | Jones | 37/451 X |

*Primary Examiner*—Terry Lee Melius
*Assistant Examiner*—Robert Pezzuto
*Attorney, Agent, or Firm*—Townsend and Townsend and Crew

[57] ABSTRACT

A lip shroud system which requires no additional hardware to hold a lip shroud on the front lip of an excavation bucket. The front shroud is held by mating lugs to the adapter and to an adjacent tooth pinned to the adapter. The lip bottom is protected by a wear plate held on the front lip by the front shroud. The front shroud is out of engagement with the lip. Thus, even if the lip shroud should loosen, it does not cause wear on the lip. The front shroud wedges between adjacent parts of the adapter, sideways movement of the adapter is virtually eliminated. This greatly reduces the lip wear in the adapter area. The front lip of the assembly is protected by the front shroud which is locked in place by the teeth associated with the adapter for coupling the tooth to the bucket wherein no additional weight is added to the system because no additional hardware is required for connecting the shroud to the bucket, thereby minimizing costs.

8 Claims, 3 Drawing Sheets

TOOTH ASSEMBLY FOR EXCAVATION BUCKET

This invention relates to an improved tooth apparatus for an excavation bucket and, more particularly, to improvements in the shrouding of the lip of an excavation bucket to eliminate or greatly reduce wear on Whisler-type bucket lips.

BACKGROUND OF THE INVENTION

Conventional lip shrouds on Whisler-type bucket lips are held in operative positions relative to the lips by some type of pin or wedging hardware. This hardware is subject to loosening during operation of the excavation bucket, and the loosening allows the shroud to move back and forth, causing wear of the bucket lip. In many cases, the hardware drops out completely thus allowing the shroud to fall off the bucket. This causes down time to replace the shroud or, in the alternative, it causes extreme wear on the lip if not immediately replaced.

Conventional lip shrouds are generally of one piece construction. This means that the same shroud can protect the front of the lip and the bottom of the lip. Usually one or the other wears out first, but the whole shroud must be replaced.

Because of the drawbacks of conventional lip shrouds and the way they are mounted, a need has arisen for improvements in such shrouds and the way they are coupled to other parts of an excavation bucket. The present invention satisfies this need.

SUMMARY OF THE INVENTION

The present invention provides a lip shroud system which requires no additional hardware to hold a lip shroud on the front lip of an excavation bucket. The front shroud is held by mating lugs to the adapter and an adjacent tooth is pinned to the adapter. The lip bottom protector is a wear plate held on the front lip by the front shroud.

The front shroud never touches the lip. Thus, even if it should loosen slightly, it cannot cause any wear on the lip.

Since the present invention is a two-part system, only the part that is worn out needs to be replaced. Since the front shroud wedges in between the two adjacent parts of the tooth adapter, sideways movement of the adapter is virtually eliminated. This greatly reduces the lip wear in the adapter area.

The primary object of the present invention is to provide an improved tooth assembly for an excavation bucket wherein the front lip of the assembly is protected by a front shroud which is locked in place by virtue of the presence of the teeth associated with the adapter for coupling the tooth to the bucket wherein no additional weight is added to the system because no additional hardware is required for connecting the shroud to the bucket, thereby minimizing the cost in applying the present invention to conventional bucket hardware.

Other objects of the present invention will become apparent as the following specification progresses, reference being had to the accompanying drawings for an illustration of the several embodiments of the invention.

DETAILED DESCRIPTION OF THE PREFERRED EMBODIMENT

Figure 1:
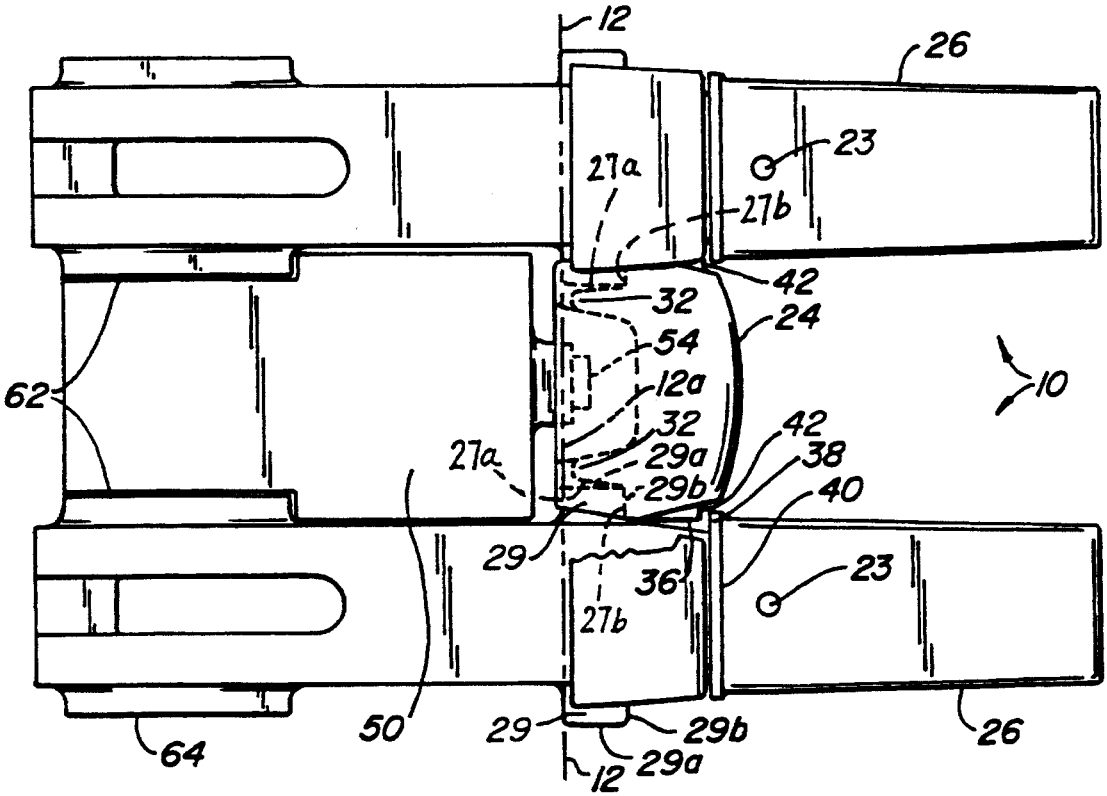
FIG. 1 is a top plan view of a lip shroud assembly with excavation teeth coupled to an adaptor attachable to an excavation bucket.
Figure 2:
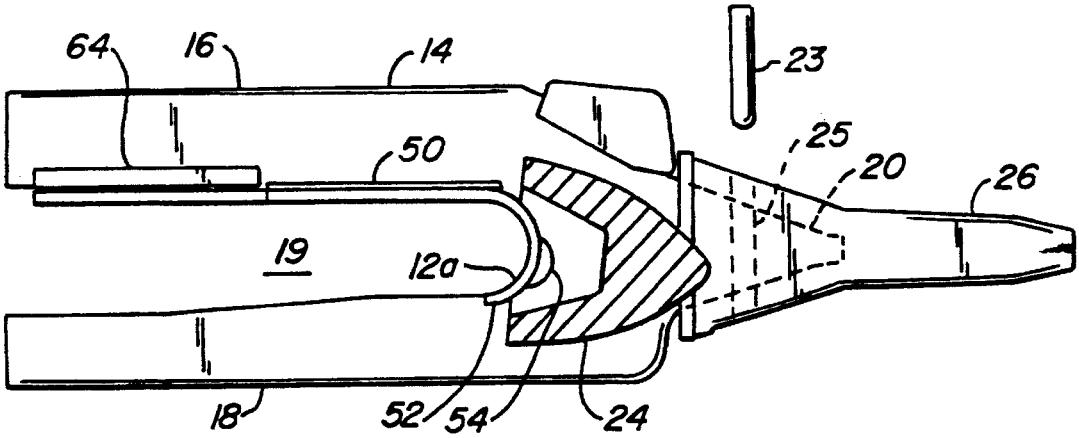
FIG. 2 is a vertical section through the assembly of FIG. 1.
Figure 3:
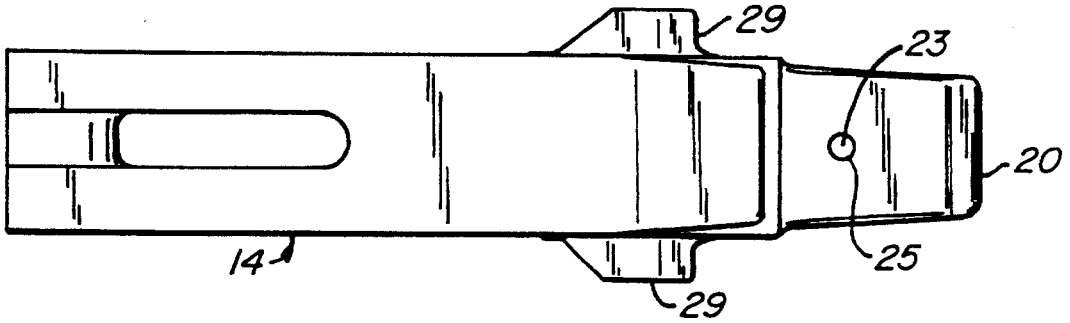
FIG. 3 is a top plan view of one form of the adapter with which the present invention is to be used.

The excavation tooth assembly using the lip shroud of the present invention is broadly denoted by the numeral 10 and is adapted to be used with an excavation bucket having a front lip 12 (FIGS. 1 and 2). There are a plurality of adapters which are carried by the lip of an excavation bucket and there is a lip part 12*a* (FIG. 1) for each adapter 14 with each adapter 14 being made up of a first member 16 and a second member 18, members 16 and 18 (FIG. 2) being vertically spaced apart and separated from each other to form a gap 19 therebetween.

Figure 4:
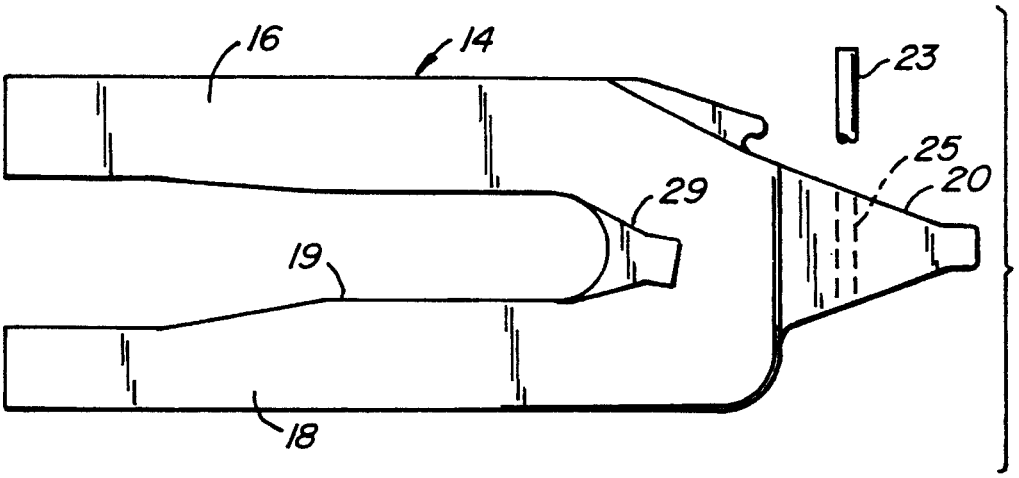
FIG. 4 is a side view of the adapter of FIG. 3.
Figure 6:
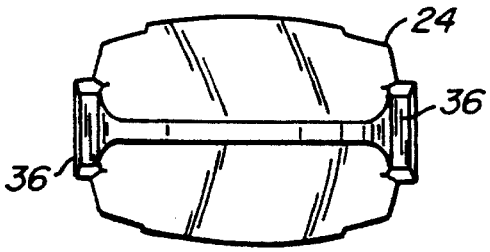
FIGS. 6 and 7 are front and side views of the lip shroud of FIG. 5.

A first embodiment of the adapter of the present invention is denoted by the numeral 14 and is shown in FIG. 4. The space 19 between members 16 and 18 of the adapter 14 of FIG. 4 is shown as extending substantially the length of the adapter, there being a conical end part 20 which is adapted to fit in the hollow end of a tooth 26. The tooth is to be held on the end part 20 by a pin 23 receivable in side holes of the tooth and in a hole 25 extending through the end part 20 transversely of the longitudinal axis of the adapter. The pin 23 and hole 25 are shown in more detail in FIG. 2. By virtue of this relationship, a pair of teeth 26 are coupled to adapter ends 20. The teeth are removably coupled to the lip because the pins 23 can be removed when desired or deemed necessary because of wear or breakage or the like.

Figure 8:
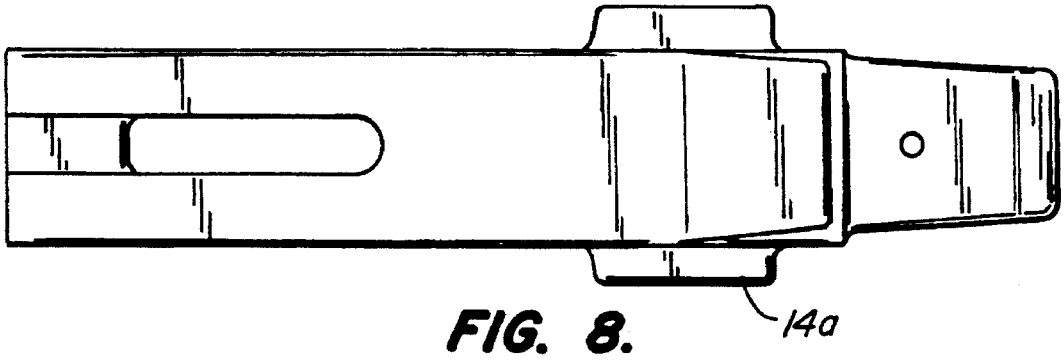
FIGS. 8 and 9 are views similar to FIGS. 3 and 4 but showing another embodiment of the adapter.
Figure 9:
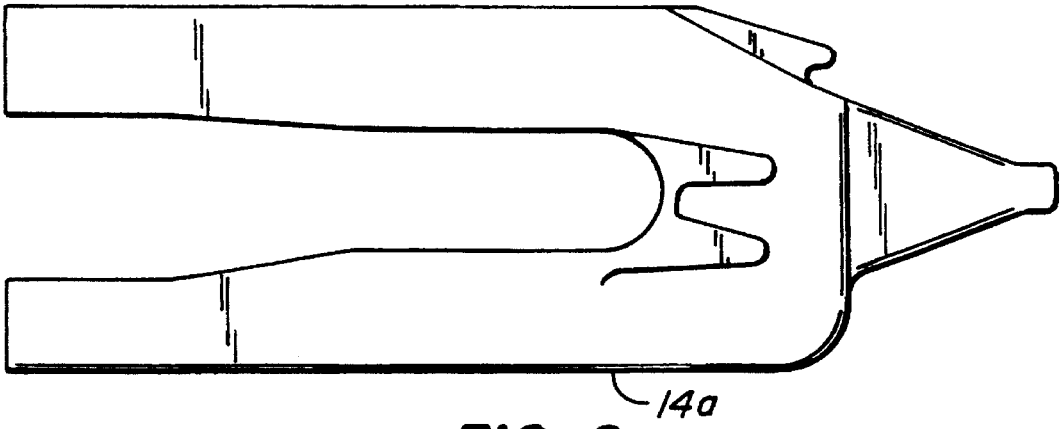
Figure 12:
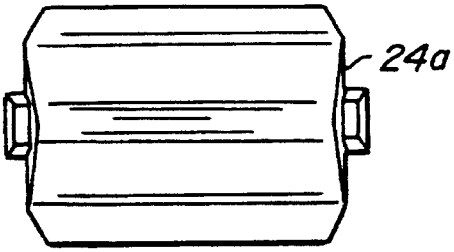
FIGS. 10, 11 and 12 are views similar to FIGS. 5, 6 and 7 but showing front, bottom and side views of the embodiment of the lip shroud to be used with the adapter of FIGS. 8 and 9.

A second embodiment of the adapter is shown in FIGS. 8 and 9 and denoted by the numeral 14*a*. The differences between the adapter embodiments of FIGS. 3 and 4 and FIGS. 8 and 9 are in the shapes of the adapter lugs to be described.

Figure 5:
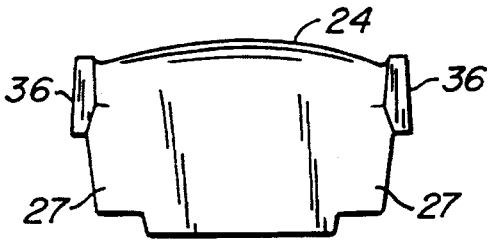
FIG. 5 is a top plan view of the lip shroud forming one embodiment of the present invention and the embodiment to be used with the adapter of FIGS. 3 and 4.
Figure 7:
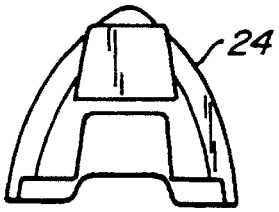
Figure 10:
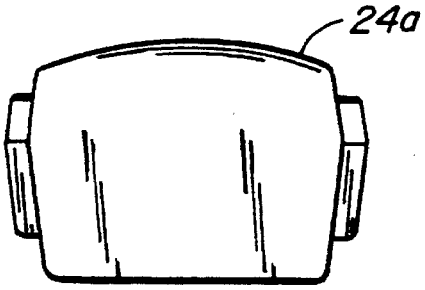
Figure 11:
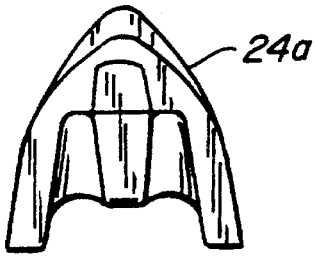

A lip shroud 24 is between the front ends 20 of adapter 14, and the lip shroud has a shroud lug defining a recess 27 at each end thereof. FIG. 5 shows one embodiment of the shroud lug and FIG. 10 shows another embodiment thereof. Each shroud recess fits over and is adjacent to an adapter lug 29. Each lug has a wall 29*a* facing a corresponding wall on the adapter lug of the adjacent adapter and a forwardly facing support surface 29*b*. The adapter lug 29 overlies the adjacent shroud recess 27 which has sides 27*a* opposite adapter walls 29*c* and mounting surfaces 27*b* engaging the support surfaces 29*b* of the adapters so that there can be no movement of the shroud transversely of the adapter 14 or rearwardly past the engagement of the mounting and support surfaces 27*b*, 29*b*. This feature forms a part of the lock means of the present invention.

Each side of lip shroud 24 has a projection 36 which is blocked by a ledge 38 of an end flange 40 of each tooth 26.

This overhang of ledge 38 with respect to a retaining surface 42 of the lug 36 prevents shifting of the lip shroud 24 in a plane parallel with the longitudinal axis of the adapter. This feature is another part of the lock means of the present invention. Such lock means thus prevents removal of the lip shroud 24 from its operative position shown in FIG. 1. In such operative position, the lip shroud 24 protects the lip 12 and lip part 12*a* (FIG. 2). Moreover, the projections 32 on the lip shroud at the rear extremity thereof fit neatly over the lip projections 54, yet the projections do not touch the lip 12 as shown by the fact that the inner ends of projections 32 are spaced from the dashed line 12*a* indicating the outermost extremity of the lip part 12.

A wear plate is carried by a tongue 52 that rests on the front of upper lip 12 as shown in FIGS. 1 and 2. The tongue 52 fits over projection 54 as shown in FIG. 2 and supports the wear plate 50 as shown in FIG. 2. The wear plate has a notch 62 which fits under a flange 64 secured to the adapter 14. The wear plate is mounted on the bottom of the adapter and protects the bottom surface of the adapter against wear.

FIGS. 5–7 and FIGS. 10–12 show two different embodiments of the lip shroud. The embodiments of the lip shrouds, identified as numerals 24 and 24*a* differ from each other in the shapes of the shroud lugs 32 and the adapters usable with these two adapter embodiments are shown in FIGS. 3 and 4 and FIGS. 8 and 9.

In assembling the adapter assembly of FIGS. 1 and 2, each pair of adapters 14 is mounted onto the lip 12. The wear plate 50 is first put in the space between the two adjacent members 16 of the adapter. The tongue 52 (FIG. 2) of the wear plate is caused to rest on the front of lip 12 as shown in FIGS. 1 and 2 and the wear plate extends rearwardly in the space between members 16. This wear plate adequately protects the bottom surface of the lip against wear.

The lip shroud 24 is then put into place by moving it into a position adjacent to the wear plate as shown in FIG. 1. Then the teeth 26 are mounted on the ends 20 of the adapter 14 and pinned by pins 23 in holes 25. When the shroud is in place, it is locked by virtue of the fact that surface 42 (FIG. 1) will butt up against surface 38 and flange 40 of the adjacent tooth 26; thus, the shroud cannot be backed off and it will be adequately protective of the front of lip 12.

I claim:

1. A tooth assembly for placement over and wear protection of a front lip of an excavation bucket comprising:

a plurality of spaced-apart adapters secured to the bucket, projecting in a forward direction past the front lip and terminating in a tooth mount located forward of the lip, adjacent adapters forming an adapter pair, each adapter pair defining opposing spaced-apart lateral walls which extend substantially in the forward direction, each adapter of the adapter pair including a forwardly facing support surface;

a shroud disposed between the adapter pair and having spaced-apart lateral sides disposed opposite the lateral walls of the adapters, rearwardly facing mounting surfaces engaging the support surfaces of the adapters, and forwardly facing retaining surfaces located proximate the respective adapters of the adapter pair, the shroud including a rearwardly facing interior side shaped to extend about the front lip of the bucket and spaced from the front lip when the mounting surfaces engage the support surfaces to thereby prevent contact between the shroud and the front lip; and a tooth removably attached to each mount of the adapter pair, the tooth including a ledge overlapping the retaining surface of the shroud to thereby mount and retain the shroud between the adapter pair.

2. A tooth assembly according to claim 1 including a wear plate placed over a forward portion of the bucket and about the front end, and wherein the adapters include means for retaining the wear plate in position on the bucket.

3. A tooth assembly according to claim 2 including a separate wear plate disposed between each adapter pair.

4. A tooth assembly according to claim 3 wherein the interior side of the shroud is spaced apart from the wear plate when the mounting surfaces of the shroud engage the support surfaces of the adapter pair.

5. A tooth assembly according to claim 4 including a projection disposed between the adapter pair projecting forwardly of the front lip, engaging the wear plate, and centering the wear plate between the adapter pair.

6. A tooth assembly according to claim 2 wherein the shroud is shaped and dimensioned so that there is play between the shroud sides and the adapter walls when the shroud is disposed between the adapter pair.

7. A tooth assembly according to claim 6 wherein the shroud is shaped and dimensioned so that there is play between the retaining surfaces of the shroud and the ledges of the teeth when the mounting surfaces of the shroud engage the support surfaces of the adapter pair.

8. A tooth assembly for placement over and wear protection of a front lip of an excavation bucket comprising:

a wear plate covering a forward portion of the bucket and extending about the front lip;

a plurality of spaced-apart adapters removably secured to the bucket, projecting in a forward direction past the front lip and terminating in a tooth mount located forward of the lip, adjacent adapters forming an adapter pair and being disposed at respective sides of the wear plate, each adapter pair defining opposing, spaced-apart lateral walls which extend substantially in the forward direction, each adapter of the adapter pair including a forwardly facing support surface located forward of the front lip of the bucket, the adapter pair including means maintaining the wear plate in position on the bucket and about the front lip;

a shroud located between the adapter pair and having spaced-apart lateral sides disposed opposite the lateral walls of the adapters, rearwardly facing mounting surfaces engaging the support surfaces of the adapters, and forwardly facing retaining surfaces located proximate the respective adapters of the adapter pair, the shroud including a rearwardly facing interior side shaped to extend about the front lip of the bucket and spaced from the front lip and the wear plate when the mounting surfaces engage the support surfaces to thereby prevent contact between the shroud, the wear plate and the front lip; and a tooth removably attached to each mount of the adapter pair, the tooth including a ledge overlapping the retaining surface of the shroud so that the shroud is mounted and retained between the adapter pair;

the shroud, the adapter pair and the teeth being shaped and dimensioned to maintain play between them while retaining the shroud in position between the adapter pair.

* * * * *